United States Patent [19]

Kochanski et al.

[11] 4,256,973

[45] Mar. 17, 1981

[54] PRESSURE SWITCH AND CIRCUIT MEANS

[75] Inventors: Aloysius J. Kochanski, Southfield, Mich.; Frank D. Mowery; Charles J. Hire, both of Mansfield, Ohio

[73] Assignee: Hi-Stat Manufacturing Company, Inc., Lexington, Ohio

[21] Appl. No.: 951,200

[22] Filed: Oct. 13, 1978

Related U.S. Application Data

[62] Division of Ser. No. 818,607, Jul. 25, 1977, abandoned.

[51] Int. Cl.[3] ..... H01H 35/24

[52] U.S. Cl. ..... 307/118; 200/81.4; 200/83 N

[58] Field of Search ..... 307/116, 118, 132 EA; 340/626, 614; 200/83 N, 83 R, 81.4, 83 S, 83 B

[56] References Cited

U.S. PATENT DOCUMENTS

| | | | |
|---|---|---|---|
| 3,475,746 | 10/1969 | Nelson et al. | 200/83 N |
| 3,631,389 | 12/1971 | Elliot | 200/81.4 X |
| 3,879,593 | 4/1975 | Larson | 200/83 N X |
| 4,037,317 | 7/1977 | Bauer et al. | 200/835 X |
| 4,160,139 | 7/1979 | Johnston | 200/83 N |

*Primary Examiner*—George H. Miller, Jr.
*Assistant Examiner*—W. J. Brady
*Attorney, Agent, or Firm*—Lon H. Romanski

[57] ABSTRACT

A pressure switch is shown as having two terminals extending externally of a switch housing within which are two stationary adjustably prepositioned fixed contacts respectively electrically connected to the two terminals; two movable contacts are also situated within the housing and, in response to sensed pressure, move toward (or away from) the fixed contacts in a manner causing sequential closing of electrical circuit portions as between respective movable contacts and fixed contacts; related electrical circuit means electrically connected to such contacts serves to energize and/or de-energize related output means as, for example, electrically operated clutch means.

26 Claims, 7 Drawing Figures

PRESSURE SWITCH AND CIRCUIT MEANS

This is a division, of application Ser. No. 818,607, filed July 25, 1977 now abandoned.

BACKGROUND OF THE INVENTION

In the prior art, there has been a need for switching devices which are effective for sensing operating pressures of related systems and to, in response to the attainment of certain preselected values of pressure, cause related circuitry and/or structure to be energized, de-energized or in any other way acted upon. Often, in the prior art, where such related circuitry and/or structure had to be acted upon in response to two or more preselected values or magnitudes of pressure, a plurality of pressure sensing switching devices were employed. This has not proven to be a totally reliable arrangement especially when it is realized that failure in one of such plurality of switches may not be sensed by the other switch devices thereby possibly resulting in damage to the overall structure. Also, with such prior art arrangements, the plurality of pressure sensing switch devices must each be carefully calibrated especially where the differences in magnitudes of preselected pressure values may be slight.

Accordingly, the invention as herein disclosed and claimed is directed primarily to the solution of the aforementioned, related and attendant problems.

SUMMARY OF THE INVENTION

According to one aspect of the invention, a pressure sensitive electrical switching assembly has a housing containing a resiliently biased pressure responsive movable wall therein which serves to divide the interior of the housing into two chambers the first of which is in communication with, for example, a reference pressure such as possibly ambient atmosphere, and the second of which is in communication with a monitored variable pressure; the pressure responsive movable wall is effective, upon sensing a sufficient magnitude of said variable pressure, to move associated electrical contact members, which comprise a portion of related make and break electrical circuitry, toward stationary electrical contacts which may be so positioned as to cause sequential engagement as between the respective movable contacts and stationary contacts.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENT

Figure 1:
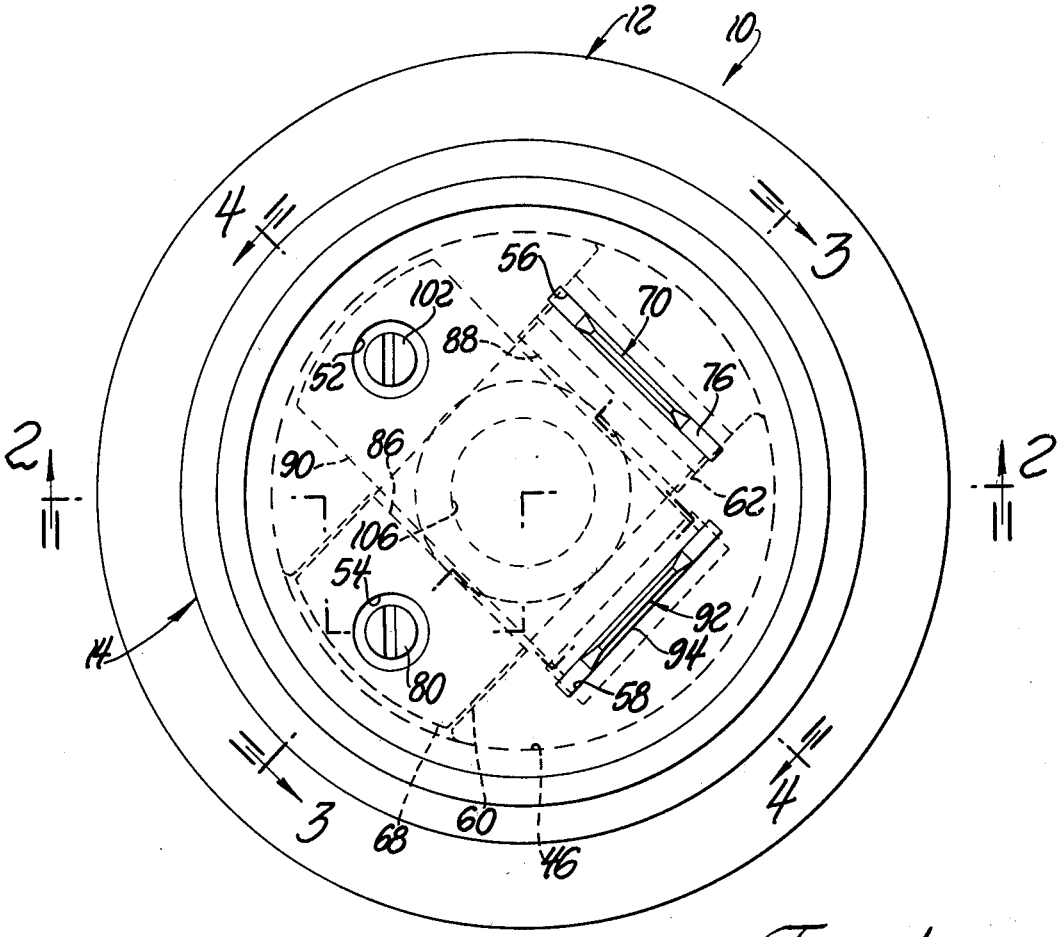
FIG. 1 is a top plan view, with certain portions illustrated in hidden line, of a pressure switch assembly embodying teachings of the invention.
Figure 2:
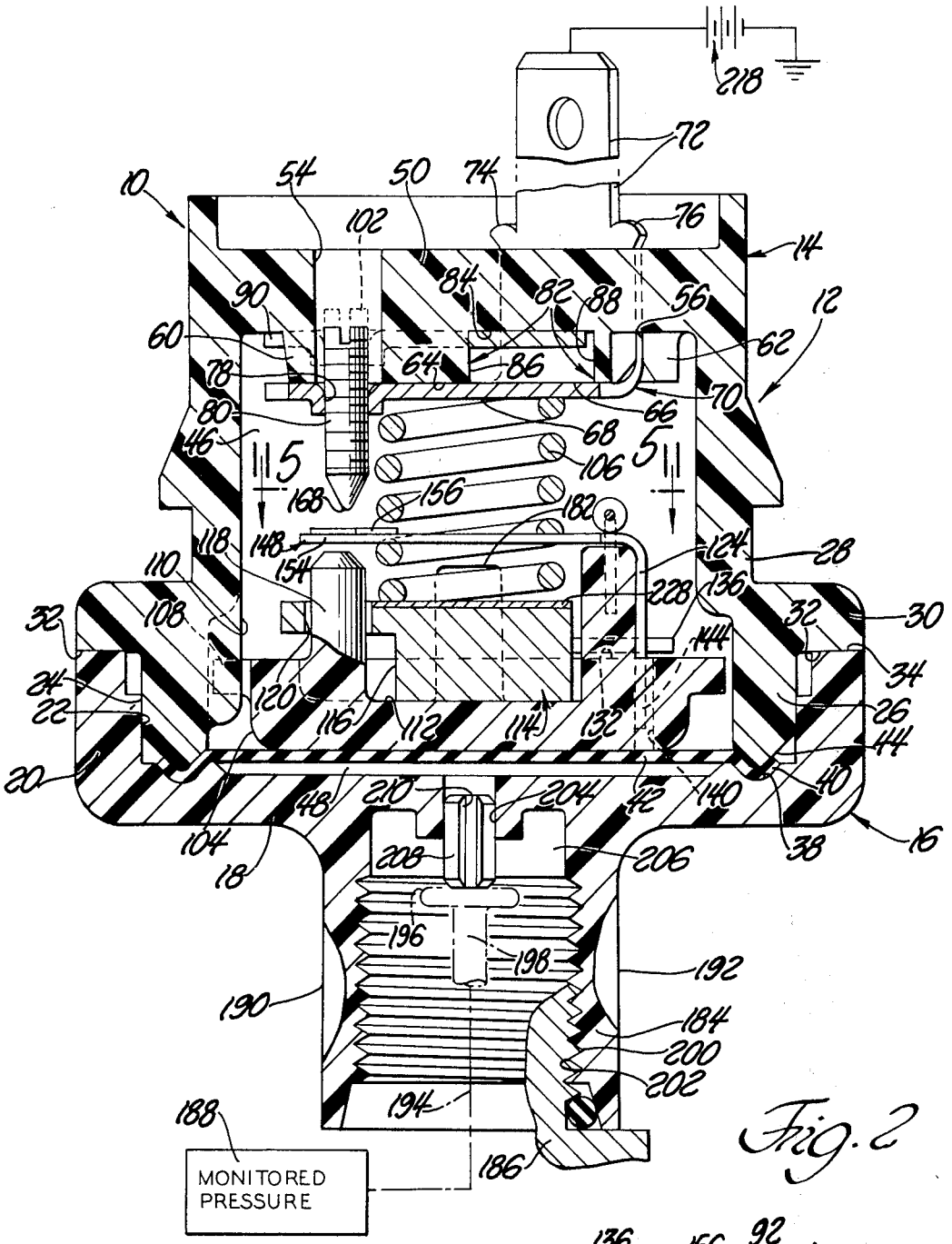
FIG. 2 is a generally axial cross-sectional view taken generally on the plane of line 2—2 of FIG. 1 and looking in the direction of the arrows.

Referring now in greater detail to the drawings, FIGS. 1 and 2 illustrate the switch assembly 10 as comprising housing means 12 comprised of an inverted cup-like upper housing section 14 and cooperating cup-like lower housing section 16. In the preferred embodiment, housing sections 14 and 16 are each formed of suitable dielectric plastic material. The disc-like wall portion 18 of lower housing section 16 is integrally formed with an upstanding annular or cylindrical wall 20 which has an inner cylindrical surface 22 effective for at least closely receiving therewithin the outer surface 24 of a cylindrical or tubular axially extending wall portion 26 of the cooperating upper housing section 14. As can best be seen in FIG. 2, the general annular side wall 28 of upper housing section 14 is provided with an annular peripheral radially outwardly extending flange portion 30 which has a downwardly directed annular mounting face or surface 32 effective for abutting engagement with a juxtaposed upwardly directed annular mounting face or surface 34 formed on the side wall portion 20 of lower housing section 16.

The upper or inner side 36 of housing section 16 wall 18 has an annular or circular recess or groove means 38 formed therein into which a generally peripheral portion 40 of pressure responsive diaphragm or movable wall means 42 is situated and retained as by the projecting annular end of tubular wall portion 26, which, preferably, is contoured as shown at 44 as to be generally complimentary to the cross-sectional contour of groove means 38. The diaphragm or movable wall means 42 thusly peripherally sealingly retained between cooperating housing sections 14 and 16 effectively defines distinct and variable chambers 46 and 48 internally of housing means 12.

The upper generally transverse wall 50 of upper housing section 14 has a plurality of clearance type apertures 52 and 54 and a plurality of slots 56 and 58 formed therethrough. The underside of wall 50 has downwardly depending wall portions 60 and 62 with coplanar surfaces 64 and 66 against which a transversely extending leg 68 of an electrical conductor or terminal member 70 is held as by the action of a generally vertically extending leg 72, of the same terminal member 70, passing through the slot 56. As best seen in FIG. 2, leg 72 may have bent-over or peened portions 74 and 76 which serve as clamping portions against wall 50 to thereby hold terminal member 70 fixed to wall 50 and hold leg 68 against surfaces 64 and 66. A threaded aperture 78 formed in leg 68 threadably engages an externally threaded electrical contact member 80 the relative axial position of which is adjustably selected as by threadable rotation thereof with access therefor being provided as by aperture 54.

Figure 3:
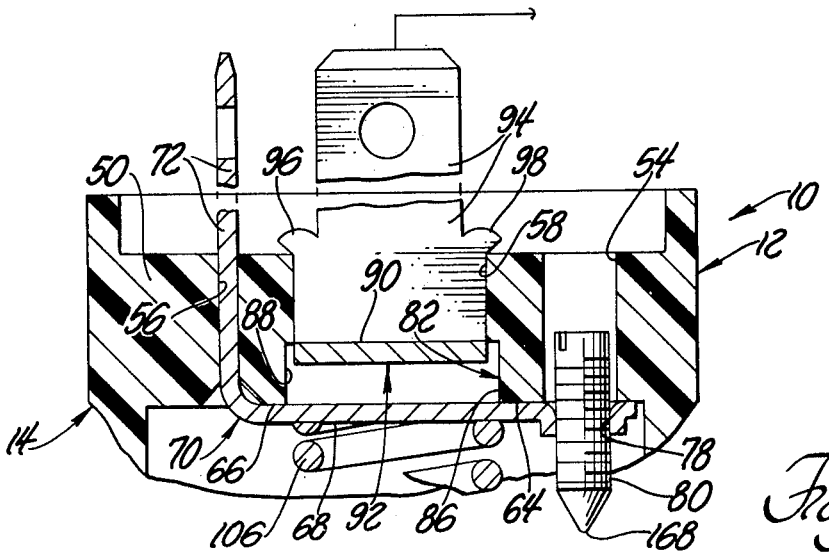
FIG. 3 is a fragmentary cross-sectional view taken generally on the plane of line 3—3 of FIG. 1 and looking in the direction of the arrows.

As seen in FIGS. 1–4, the depending wall portions 60 and 62 are generally spaced from each other as by a recess or slot 82 having an upper transverse surface 84 joining generally vertically extending side walls 86 and 88. The slot 82 accommodates the passage therethrough of leg 90 of a second electrical conductor or terminal member 92 and enables such leg 90 to be held against upper surface 84 as by the action of a generally vertically extending leg 94, of the same terminal member 92, passing through the slot 58. As best seen in FIG. 3, leg 94 may have bent-over or peened portions 96 and 98 which serve as clamping portions against the top of wall 50 to thereby hold terminal member 92 fixed to wall 50 and hold leg 90 against surface 84. A threaded aperture 100 formed in leg 90 threadably engages an externally threaded electrically conductive contact member 102 the relative axial position of which is adjustably selected as by threadable rotation thereof with access therefor being provided as by aperture means 52.

Figure 5:
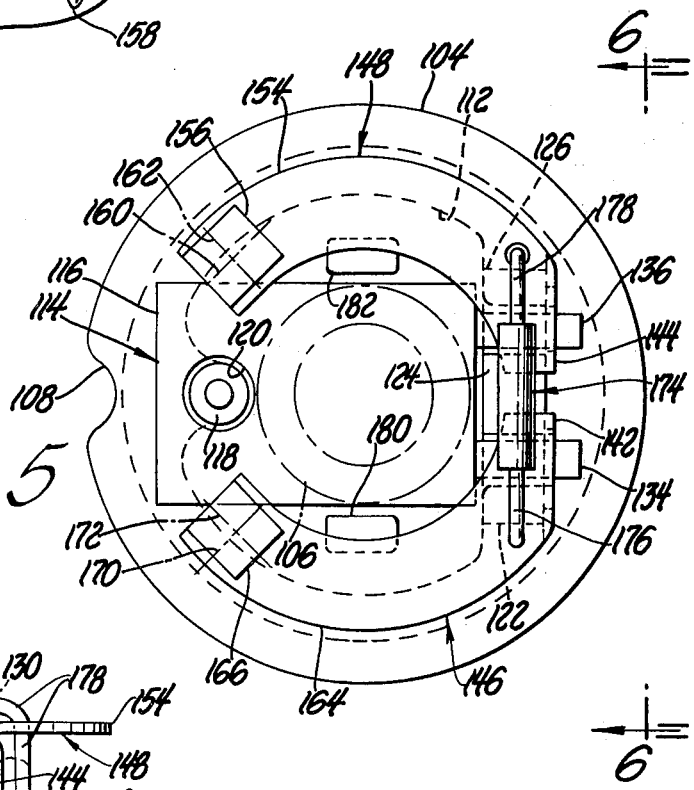
FIG. 5 is a top plan view of certain elements shown in FIG. 2 taken generally on the plane of line 5—5 of FIG. 2 and looking in the direction of the arrows.
Figure 6:
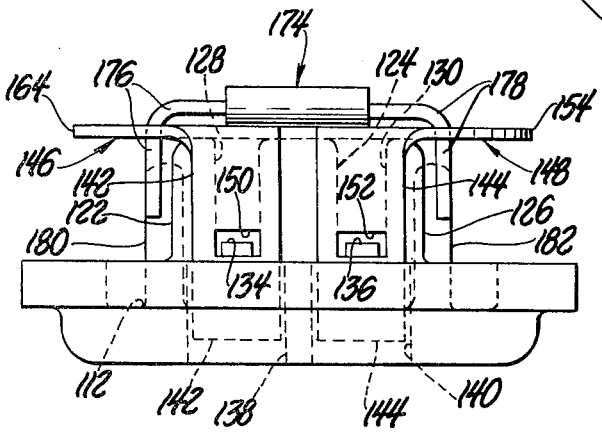
FIG. 6 is an elevational view taken generally on the plane of line 6—6 of FIG. 5 and looking in the direction of the arrows.

Referring now in greater detail to FIGS. 2, 5 and 6, a switch body 104, generally circular in top plan view is situated within chamber 46 and resiliently biased against the upper surface of diaphragm wall 42 as by spring means 106 in a manner to be more completely described. As best seen in FIGS. 2 and 5, a guide groove, slot or recess 108 is formed in the periphery of body 104 as to slidingly cooperate with generally vertically extending guide means or rib 110 carried internally of upper housing 14 and preferably formed integrally therewith.

Body 104, at its upper side, has a recessed surface 112 formed therein for the reception of related circuit portion means 114 which, in one successful embodiment of the invention comprised a silicon controlled rectifier (SCR) chip No. EEC-50306-RS-2, which had an overall enveloping type body or housing 116 provided with an upwardly disposed electrically conductive plate 228 electrically connected to the anode of such SCR and against which the electrically conductive spring 106 seats. A vertically extending cylindrical post 118 carried by switch body or carrier 104 passes through a cooperating aperture 120 formed in chip body 116 as to provide for relative angular location thereof.

Generally diametrically opposite to post or retainer 118, body 104 carries a plurality of upwardly directed pedestal-like portions 122, 124 and 126 which, sequentially cooperate to define vertically extending slots 128 and 130 therebetween each terminating at an elevation as at 132 (FIG. 2). Such slots 128 and 130 are of widths sufficient to permit the passage therethrough, respectively, of leads 134 and 136 of the circuit portion means 114. Body 104 is provided with additional slots or recesses 138 and 140 which, as viewed in FIG. 6, are in general vertical alignment, respectively, with slots 128 and 130. Such slots 138 and 140 respectively receive and retain therein ends or arms 142 and 144 of leaf contact members 146 and 148. As best seen in FIG. 6, arms 142 and 144 are respectively provided with openings or apertures 150 and 152 for the respective reception of leads 134 and 136 therethrough. Preferably, leads 134 and 136 are respectively electrically connected to arms 142 and 144 as by soldering (not shown for sake of clarity). Leaf contacts 146 and 148 may be formed of any suitable material; in the preferred embodiment such are formed of beryllium copper.

As can be seen in FIGS. 2, 5 and 6, the generally laterally extending arcuate arm 154 of leaf contact 148 generally overlies the top of and is supported, in a cantilevered manner, by pedestal portions 124 and 126 as to have its free end, provided preferably with a brazed silver alloy contact 156, situated below the end 158 of contact 102 so as to have the axis of such contact 102 in general alignment with the intersection of centerlines 160 and 162.

Similarly, the generally laterally extending arcuate arm 164 of leaf contact 146 generally overlies the top of and is supported, in a cantilevered manner, by pedestal portions 122 and 124 as to have its free end, preferably provided with a brazed silver alloy contact 166, situated below the end 168 of contact 80 so as to have the axis of such contact 80 in general alignment with the intersection of centerlines 170 and 172. A resistor 174 situated generally atop leaf contacts 146 and 148, has its opposite leads 176 and 178 passing through cooperating respective apertures formed in arm portions 164 and 154 with such leads 176 and 178 being suitably electrically connected thereto as by, for example, soldering.

Figure 4:
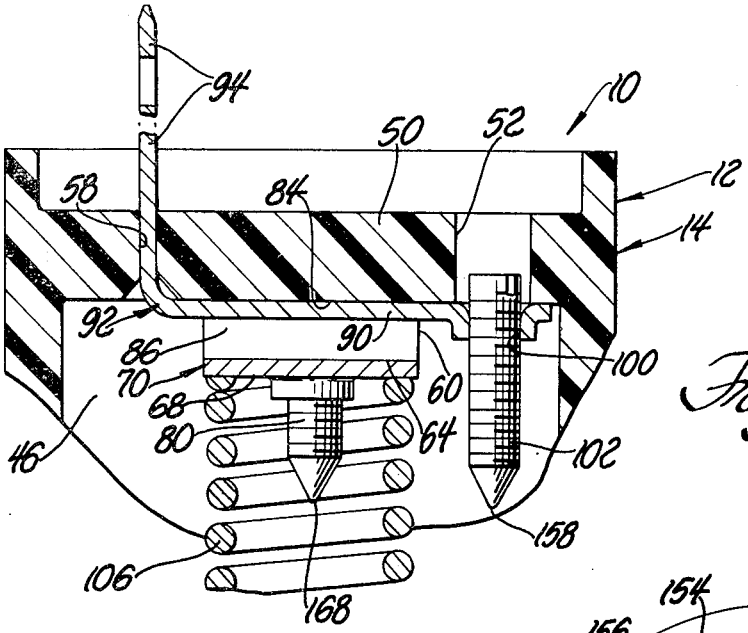
FIG. 4 is a fragmentary cross-sectional view taken generally on the plane of line 4—4 of FIG. 1 and looking in the direction of the arrows.

As also shown in FIGS. 2, 5 and 6, additional vertically upstanding posts or members 180 and 182 are carried by body 104 and serve to not only further contain chip body 116 but also contain the lower end of spring 106 which is seated against the upper surface of such chip body 116. The upper end of spring 106 is suitably seated as against leg 68 of terminal member 70 as best shown in FIGS. 2, 3 and 4.

Although upper and lower housing sections 14 and 16 may be secured to each other by any suitable means, in the preferred embodiment of the invention the juxtaposed surfaces 32 and 34 are sonically welded to each other. As can be seen, an important feature of the invention is the automatic alignment of all coacting elements accomplished merely as a result of normal assembly thereof. That is, because of the various switching or contact elements carried by switch body 104 being fixedly indexed with reference to such body 104, and because of the contact members 80 and 102 being fixedly indexed with reference to upper housing section 14 and, further, because the switch body 104 and upper housing section 14 are further indexed with respect to each other via guide or indexing means 108 and 110, the act of assembling all of such elements automatically assures proper operating alignment as between contact 80 and leaf contact arm 164 as well as between contact 102 and leaf contact arm 154. Therefore, it is of no consequence as to the relative angular position that lower housing section 16 assumes with respect to upper housing section 14 during assembly of such housing sections.

As shown in FIG. 2, the transverse wall 18 of lower housing section 16 is provided as with a downwardly depending internally threaded generally tubular extension 184 adapted as for threadable connection via suitable connector means, fragmentarily shown at 186, to related means 188 of which the pressure is to be monitored. The extension 184 may have, as is well known in the art, suitable tool engaging surfaces, as for example, flatted surfaces 190 and 192 whereby related tool means may be engaged for threadably connecting the assembly 10 to the related connector means 186.

In certain situations, as in for example those situations where the switch means 10 may be employed in combination with a refrigeration system, the connector means 186 may actually comprise a valving assembly which, when closed, would contain, under pressure, a suitable gas as, for example, freon, within conduit means 194 and related means 188. The valving means thusly employed is more often than not of the configuration commonly referred to as a "tire valve assembly" wherein a valve stem is axially movable against the resilient resistance of an associated spring in order to complete communication past the valve associated with such valve stem. Unfortunately, quite often the axial position of the actuating head 196 of such a valve stem 198 relative to the remainder of the connector means 186 will vary as between any two connector means. Such variation may be further aggravated as by the relative axial position and/or location of the thread 200 formed on the connector as well as the thread 202 formed within extension 184. Accordingly, the invention provides means whereby any such pressure switching means 10 can be connected to any cooperating connector means 186 without regard to any such variation in the location of the actuating head 196 of valve stem 198.

Referring to FIG. 2, the invention provides passage means 204 formed through wall portion 18 as to communicate between chamber 48 and conduit portion 206 within extension 184. Situated within such passage 204 is a generally tubular member 208 having a single split-like portion 210 in the wall thereof. Commonly, such members 208 are often referred to as "roll pins" and are formed as to be generally somewhat resiliently deflectable in a radial direction. In any event, member 208 is selected of a size as to result in a press-fit within passage 204 thereby providing a frictional resistance, to its axial displacement, sufficient to assure that when actuating head 196 abuts thereagainst such valve stem 198 will be moved downwardly (relative to the remaining portion of connector assembly 186 as it is being threadably moved upwardly into extension 184) against its associated biasing spring means in order to complete communication between conduit means 194 and conduit 206. However, if the actuating head 196 (in the assumed connector means 186) should be situated relatively too far forwardly or upwardly thereof, the frictional resistance of member or actuator 208 is insufficient to prevent such actuating head 196 and stem 198 from moving member 208 upwardly within passage 204 a distance sufficient to fully accommodate the seating connection of connector means 186 to extension 184. Because of the split or opening 210, communication between chamber 48 and conduit 206 is assured regardless of the position of member 208.

OPERATION OF THE INVENTION

Even though it will be, if not already, obvious that the switch means of the invention is fully capable of performing a duty cycle involving only one preselected magnitude of monitored pressure, for purposes of discussion, let it be assumed that it is desired to create certain outputs in response to two different magnitudes of monitored pressure and that such monitored pressure is from a single gas source. Further, let it be assumed that in FIG. 7: (a) the output means 212 comprises electrically energized clutch means; (b) means 214 comprises power transmission means connected to any suitable power generating means 215 and leading to one operative side of the clutch means 212; and (c) means 216 comprises power transmission means leading from an other operative side of the clutch means to related suitable refrigeration compressor means 217. Further, let it be assumed that such compressor means is effective for compressing freon (or other suitable refrigerant) within the overall refrigeration system and that means 188 comprises a portion of such system as, for example, the relatively low pressure side thereof. Also, let it be assumed that when the magnitude of the monitored pressure reaches 44.0 lbs./sq. in. that it is desired to actuate clutch means 212 in order to thereby drive the related compressor means 217. In this respect, let it also be assumed that once clutch means 212 is thusly energized, that de-energization thereof is not to occur until the magnitude of the monitored pressure reaches 26 lbs./sq.in.

Figure 7:
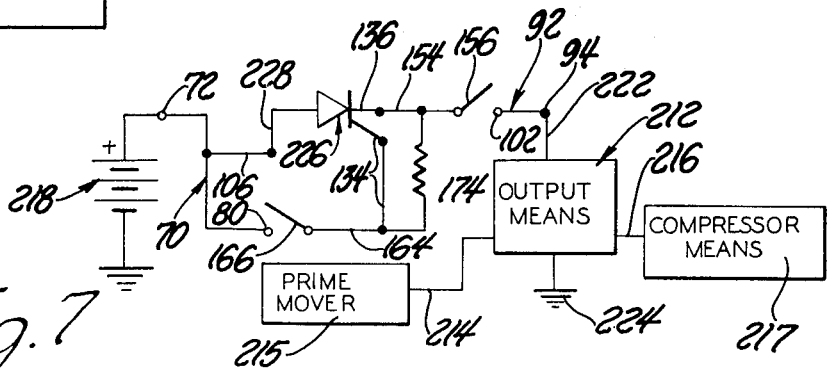
FIG. 7 is a schematic wiring diagram illustrating certain of the elements shown in the preceding Figures in association with other electrical means comprising overall circuit means.

Also, with regard to FIGS. 2, 3 and 7, a suitable source of electrical potential 218 is shown suitably electrically connected, as via conductor means 220, to terminal member 70 while, in FIG. 3, leg 94 of terminal member 92 is shown electrically connected to conductor means 222. With reference to FIG. 7, it can be seen that such conductor means 222 leads to the clutch or output means 212 which, in turn, is grounded as at 224. As schematically depicted in FIG. 7, the solid state means 114 comprises a silicon controlled rectifier (SCR) 226 which has its anode, comprised as of the upper metal surface 228 of the housing or body means 116 containing such SCR, electrically connected to the source of electrical potential as through spring 106 and leg 68 of terminal means 70.

Now, assuming that leafs 164 and 154 as well as contacts 166 and 156 carried thereby are generally in the same respective elevational planes, contact 102 would be adjusted as to have its end 158 disposed lower than end 168 of contact 80. The positions of such contact ends 158 and 168 would be as to result in having fixed contact end 158 engage and complete a circuit portion through cooperating movable contact 156 of leaf contact arm 154 when the sensed magnitude of the monitored pressure was the previously assumed magnitude of 26.0 lbs./sq. in. Likewise fixed contact end 168 would engage and complete a circuit portion through cooperating movable contact 166 of leaf contact arm 164 when the sensed magnitude of the monitored pressure was the previously assumed magnitude of 44.0 lbs./sq. inch.

Generally, it should be apparent that as the magnitude of the pressure within the monitored vessel or means 188 increases sufficiently, the piston means, comprised of movable wall means 42 and body means 104, will start to move upwardly against the resilient resistance of spring means 106 and initial contact is made as between contact members 102 and 156 (at said assumed 26.0 lbs./sq. inch) and that subsequent contact is made as between contact members 80 and 166 (at said assumed 44.0 lbs./sq. inch).

In order to possibly better appreciate the operation of the circuitry shown in FIG. 7, it might be best to describe the characteristics of the SCR 226 with its anode terminal 228, cathode terminal 136 and gate terminal 134. Generally, in order to make an SCR conductive, forwardly, it is necessary to apply a voltage across the anode to cathode terminals of the SCR (making the anode positive, +, with respect to the cathode) and at the same time apply a voltage (or current flow) to the gate-to-cathode circuit by making the gate positive, +, with respect to the cathode. Another characteristic of an SCR is that once it is conductive the SCR remains conductive until such time as the anode to cathode current is interrupted. Therefore, in the circuitry of FIG. 7, SCR 226 will become conductive only upon contacts 156 and 102 becoming closed and, during such closure, contacts 80 and 166 also becoming closed. Further, once SCR 226 is thusly made conductive through its anode 228 and cathode 136, the opening of the contacts 80, 166 (and therefore removing the positive bias on the gate electrode 134) will not interrupt the previously established conductivity of the SCR through its anode-cathode circuit.

Now, referring to FIGS. 1–4 and 7, let it be assumed that the magnitude of the sensed monitored pressure, as the low pressure side of a refrigerant, is initially below the assumed magnitude of 26 lbs./sq. inch. At this time the pressure responsive piston means 104 and 42 will be in a position as generally depicted in FIG. 2 and cooperating pairs of switch contacts 80, 166 and 102, 156 will be open as shown in FIG. 7 thereby causing clutch means 212 to be disengaged and not permitting the power supply or prime mover means 215 to drive the compressor 217.

As the magnitude of said sensed monitored pressure increases, piston means 42 and 104 is, in response thereto, caused to move upwardly against the resilient resistance of spring means 106; this action continues until the magnitude of said sensed monitored pressure becomes 26 lbs./sq. inch at which time switch body 104 has been moved upwardly sufficiently to cause contact 156, carried by leaf contact arm 154, to become engaged by the fixed contact 102 thereby closing the circuit portion defined thereby and, as shown in FIG. 7, causing the circuit described by SCR cathode 136, contact arm 154, contacts 156 and 102, terminal member 92 and conductor means 222 leading to clutch means 212 to be closed. However, as was previously noted, because of the characteristics of the SCR 226, the circuit from its anode 228 to its cathode 136 is not yet made conductive.

As the magnitude of the said sensed monitored pressure continues to increase, piston means 104, 42, continues to move upwardly in response thereto while still maintaining contacts 156 and 102 closed during such further upward movement. When the magnitude of the sensed monitored pressure becomes 44.0 lbs./sq. inch switch body 104 will have moved upwardly sufficiently to cause contact 166, carried by leaf contact arm 164, to become engaged by the fixed contact 80 thereby closing the circuit portion defined thereby and, as shown in FIG. 7, causing the circuit described by terminal 70, contacts 80, 166, leaf contact arm 164 and resistor 174 to be closed. The resistor 174, in turn, because of the voltage drop thereacross, causes the SCR gate 134 to be positive (+) with respect to the cathode 136. Accordingly, in view of the previous discussion, it can be seen that all requirements are fulfilled for causing the SCR 226 to be conductive through its anode to cathode circuit and, of course, current flow is supplied from the source 218, through terminal 70, spring conductor 106, annode terminal or plate conductor 228, cathode 136, leaf contact arm 154, contacts 156, 102, terminal member 92 and conductor means 222 to the clutch means 212 thereby actuating such clutch means 212 and enabling the power generating or driving means 215 to drive (through transmission means 214, clutch 212 and transmission means 216) compressor 217 which, as is well known in the art, serves to compress the said refrigerant.

Once the conduction through the anode to cathode circuit is established subsequent reduction of the magnitude of the sensed monitored pressure will not immediately cause a termination of such conduction. That is, if it is assumed that after the compressor 217 has started to be driven, the magnitude of the sensed monitored pressure decreases to, for example, 30.0 lbs./sq. inch, spring 106, of course, will have moved switch body 104 downwardly a distance sufficient to open cooperating contacts 80 and 166. However, because of the previously explained characteristics of the SCR 226, conduction through the anode to cathode circuit thereof continues even after the removal of the positive (+) bias on the gate 134. Therefore, in the arrangement disclosed, the compressor 217 will continue to be driven through clutch means 212 until the magnitude of the said sensed monitored pressure diminishes to a value less than 26.0 lbs./sq. inch. at which point, of course, spring 106 will have moved switch body 104 downwardly a distance sufficient to open cooperating contacts 156 and 102. In view of the preceding, it should be apparent that neither the SCR 226 will again be made conductive nor clutch means 212 energized for driving compressor 217 until the magnitude of the sensed monitored pressure again attains the assumed 44.0 lbs./sq. inch.

As is apparent, the invention not only provides switch means capable of opening and closing circuit portions at various sensed pressures, but also provides circuit means whereby related or associated elements, such as the output means 212 or compressor means 217, are precluded from continually cycling, in a generally unstable or hunting mode, due to slight (or preselected) variations or changes occurring in the magnitude of the sensed pressure.

Although only one preferred embodiment of the invention has been disclosed and described, it is apparent that other embodiments and modifications of the invention are possible within the scope of the appended claims.

We claim:

1. A pressure responsive electrical switch assembly, comprising housing means, pressure responsive movable wall means carried by said housing means, said movable wall means effectively defining first and second chamber means within said housing means, at least first and second stationary contact means operatively carried by said housing means, at least first and second movable contact means operatively carried by said movable wall means, solid state electrical circuit means operatively carried by said movable wall means and electrically connected to said first and second movable contact means, resilient means normally operatively biasing said movable wall means in a direction toward said first chamber means and operatively biasing said first and second movable contact means in a direction away from said first and second stationary contact means, first electrical terminal means forming an electrical extension of said first stationary contact means, and second electrical terminal means forming an electrical extension of said second stationary contact means.

2. A pressure responsive electrical switch assembly according to claim 1 and further comprising passage means carried by said housing means adapted for connection to associated connector means leading to related structure containing fluid under pressure the magnitude of which is to be monitored by said switch assembly, conduit means formed in said housing means for completing communication as between said passage means and said first chamber means, and relatively yieldingly movable abutment means carried by said housing means effective for abuttingly operatively engaging related valving means carried by said associated connector means to thereby complete communication of said fluid under pressure to said passage means, said abutment means being yieldingly movable to accommodate variations in the effective length of said related valving means.

3. A pressure responsive electrical switch assembly according to claim 2 wherein said relatively yieldingly movable abutment means comprises pin means axially displaceable within said housing means.

4. A pressure responsive electrical switch assembly according to claim 2 wherein said movable abutment means comprises roll pin means frictionally retained at least partly within said conduit means.

5. A pressure responsive electrical switch assembly according to claim 1 wherein said first and second stationary contact means and said first and second movable contact means are so physically positioned with respect to each other that sequential closing of said first stationary and movable contact means and said second stationary and movable contact means occurs when said movable wall means is moved a sufficient distance generally toward said second chamber means by the force of sensed pressure within said first chamber means.

6. A pressure responsive electrical switch assembly, comprising housing means, pressure responsive movable wall means carried by said housing means, said movable wall means effectively defining first and second chamber means within said housing means, at least first and second stationary contact means operatively carried by said housing means, at least first and second movable contact means operatively carried by said movable wall means, solid state electrical circuit means operatively carried by said movable wall means and electrically connected to said first and second movable contact means, resilient means normally operatively biasing said movable wall means in a direction toward said first chamber means and operatively biasing said first and second movable contact means in a direction away from said first and second stationary contact means, first electrical terminal means forming an electrical extension of said first stationary contact means, and second electrical terminal means forming an electrical extension of said second stationary contacting means, said first and second stationary contact means and said first and second movable contact means being so physically positioned with respect to each other that sequential closing of said first stationary and movable contact means occurs when said movable wall means is moved a sufficient distance generally toward said second chamber means by the force of sensed pressure within said first chamber means, said first and second movable contact means being generally coplanar, and said first and second stationary contact means being located as to be effectively at different operational elevations with respect to each other and with respect to said first and second movable contact means.

7. A pressure responsive electrical switch assembly, comprising housing means, pressure responsive movable wall means carried by said housing means, said movable wall means effectively defining first and second chamber means within said housing means, at least first and second stationary contact means operatively carried by said housing means, at least first and second movable contact means operatively carried by said movable wall means, solid state electrical circuit means operatively carried by said movable wall means and electrically connected to said first and second movable contact means, resilient means normally operatively biasing said movable wall means in a direction toward said first chamber means and operatively biasing said first and second movable contact means in a direction away from said first and second stationary contact means, first electrical terminal means forming an electrical extension of said first stationary contact means, second electrical terminal means forming an electrical extension of said second stationary contact means, said housing means comprising first and second housing sections, said pressure responsive wall means comprising pressure responsive movable diaphragm means generally peripherally contained and retained between cooperating portions of said first and second housing sections, and switch body means operatively carried by said diaphragm means, said first and second movable contact means each being supported on said switch body means, said solid state electrical circuit means being supported on said switch body means, said solid state electrical circuit means comprising anode cathode and gate terminal means, said cathode terminal means being electrically connected to one of said first and second movable contact means, said gate terminal means being electrically connected to an other of said first and second movable contact means, said resilient means comprising electrically conductive spring means, and said spring means electrically interconnecting said anode terminal means to one of said first and second electrical terminal means.

8. A pressure responsive electrical switch assembly according to claim 7 wherein said first movable contact means comprises a first leaf contact arm having a first end thereof situated in a cantilevered manner from a first support leg associated therewith, wherein said second movable contact means comprises a second leaf contact arm having a second end situated in a cantilevered manner from a second support leg associated therewith, each of said first and second leaf contact arms being of an arcuate configuration as to have said first and second support legs and said first and second ends respectively spaced relatively close to each other while the portions of each of said contact arms generally between said first and second ends and said first and second support legs being generally bowed away from each other to define a relatively enlarged clearance space therebetween, wherein said spring means comprises a coiled compression spring, and wherein said coiled compression spring extends through said clearance space.

9. A pressure responsive electrical switch assembly according to claim 7 and further comprising guide means effective for preventing undesirable angular rotation as between said switch body means and said housing means.

10. A pressure responsive electrical switch assembly according to claim 9 wherein said guide means comprises cooperating rib and slot means.

11. A pressure responsive electrical switch assembly according to claim 10, wherein said rib means is formed internally of said housing means, and wherein said slot means is formed generally peripherally of said switch body means.

12. A pressure responsive electrical switch assembly, comprising housing means, pressure responsive movable wall means carried by said housing means, said movable wall means effectively defining first and second chamber means within said housing means, at least first and second stationary contact means operatively carried by said housing means, at least first and second movable contact means operatively carried by said movable wall means, solid state electrical circuit means operatively carried by said movable wall means and electrically connected to said first and second movable contact means, resilient means normally operatively biasing said movable wall means in a direction toward said first chamber means and operatively biasing said first and second movable contact means in a direction away from said first and second stationary contact means, first electrical terminal means forming an electrical extension of said first stationary contact means, and second electrical terminal means forming an electrical extension of said second stationary contact means, said solid state electrical circuit means comprising anode cathode and gate terminal means, said cathode terminal means being electrically connected to one of said first and second movable contact means, said gate terminal means being electrically connected to an other of said first and second movable contact means, said resilient means comprising electrically conductive spring means, and said spring means electrically interconnecting said anode terminal means to one of said first and second electrical terminal means.

13. A pressure responsive electrical switch assembly, comprising housing means, fluid pressure responsive movable wall means carried by said housing means, said movable wall means effectively defining first and second chamber means within said housing means, at least first and second stationary contact means operatively carried by said housing means, at least first and second movable contact means operatively carried by said movable wall means, solid state electrical circuit means operatively carried by said movable wall means and electrically connected to said first and second movable contact means, and resilient means normally operatively biasing said movable wall means in a direction toward said first chamber means and operatively biasing said first and second movable contact means in a direction away from said first and second stationary contact means.

14. A pressure responsive electrical switch assembly according to claim 13 and further comprising passage means carried by said housing means adapted for connection to associated connector means leading to related structure containing fluid under pressure the magnitude of which is to be monitored by said switch assembly, conduit means formed in said housing means for completing communication as between said passage means and said first chamber means, and relatively yieldingly movable abutment means carried by said housing means effective for abuttingly operatively engaging related valving means carried by said associated connector means to thereby complete communication of said fluid under pressure to said passage means, said abutment means being yieldingly movable to accommodate variations in effective length of said related valving means.

15. A pressure responsive electrical switch assembly according to claim 14 wherein said relatively yieldingly movable abutment means comprises pin means axially displaceable within said housing means.

16. A pressure responsive electrical switch assembly according to claim 14 wherein said movable abutment means comprises roll pin means frictionally retained at least partly within said conduit means.

17. A pressure responsive electrical switch assembly according to claim 13 wherein said first and second stationary contact means and said first and second movable contact means are so physically positioned with respect to each other that sequential closing of said first stationary and movable contact means and said second stationary and movable contact means occurs when said movable wall means is moved a sufficient distance generally toward said second chamber means by the force of sensed fluid pressure within said first chamber means.

18. A pressure responsive electrical switch assembly, comprising housing means, fluid pressure responsive movable wall means carried by said housing means, said movable wall means effectively defining first and second chamber means within said housing means, at least first and second stationary contact means operatively carried by said housing means, at least first and second movable contact means operatively carried by said movable wall means, solid state electrical circuit means operatively carried by said movable wall means and electrically connected to said first and second movable contact means, and resilient means normally operatively biasing said movable wall means in a direction toward said first chamber means and operatively biasing said first and second movable contact means in a direction away from said first and second stationary contact means, said first and second stationary contact means and said first and second movable contact means being so physically positioned with respect to each other that sequential closing of said first stationary and movable contact means and said second stationary and movable contact means occurs when said movable wall means is moved a sufficient distance generally toward said second chamber means by the force of sensed fluid pressure within said first chamber means, said first and second movable contact means being generally coplanar, and said first and second stationary contact means being located as to be effectively at different operational elevations with respect to each other and with respect to said first and second movable contact means.

19. A pressure responsive electrical switch assembly, comprising housing means, fluid pressure responsive movable wall means carried by said housing means, said movable wall means effectively defining first and second chamber means within said housing means, at least first and second stationary contact means operatively carried by said housing means, at least first and second movable contact means operatively carried by said movable wall means, solid state electrical circuit means operatively carried by said movable wall means and electrically connected to said first and second movable contact means, resilient means normally operatively biasing said movable wall means in a direction toward said first chamber means and operatively biasing said first and second movable contact means in a direction away from said first and second stationary contact means, said housing means comprising first and second housing sections, said pressure responsive wall means comprising pressure responsive movable diaphragm means generally peripherally contained and retained between cooperating portions of said first and second housing sections, and further comprising switch body means operatively carried by said diaphragm means, said first and second movable contact means each being supported by said switch body means, said solid state electrical circuit means being supported by said switch body means, said solid state electrical circuit means comprising anode cathode and gate terminal means, said cathode terminal means being electrically connected to one of said first and second movable contact means, said gate terminal means being electrically connected to an other of said first and second movable contact means, said resilient means comprising electrically conductive spring means, and said spring means electrically interconnecting said anode terminal means to one of said first and second stationary contact means.

20. A pressure responsive electrical switch assembly according to claim 19 wherein said first movable contact means comprises a first leaf contact arm having a first end thereof situated in a cantilevered manner from a first support leg associated therewith, wherein said second movable contact means comprises a second leaf contact arm having a second end situated in a cantilevered manner from a second support leg associated therewith, each of said first and second leaf contact arms being of an arcuate configuration as to have said first and second support legs and said first and second ends respectively spaced relatively close to each other while the portions of each of said contact arms generally between said first and second ends and said first and second support legs being generally bowed away from each other to define a relatively enlarged clearance space therebetween, wherein said spring means comprises a coiled compression spring, and wherein said coiled compression spring extends through said clearance space.

21. A pressure responsive electrical switch assembly according to claim 19 and further comprising guide means effective for preventing undesirable angular rotation as between said switch body means and said housing means.

22. A pressure responsive electrical switch assembly according to claim 21 wherein said guide means comprises cooperating rib and slot means.

23. A pressure responsive electrical switch assembly according to claim 22 wherein said rib means is formed internally of said housing means, and wherein said slot means is formed generally peripherally of said switch body means.

24. A pressure responsive electrical switch assembly, comprising housing means, fluid pressure responsive movable wall means carried by said housing means, said movable wall means effectively defining first and second chamber means within said housing means, at least first and second stationary contact means operatively carried by said housing means, at least first and second movable contact means operatively carried by said movable wall means, solid state electrical circuit means operatively carried by said movable wall means and electrically connected to said first and second movable contact means, and resilient means normally operatively biasing said movable wall means in a direction toward said first chamber means and operatively biasing said first and second movable contact means in a direction away from said first and second stationary contact means, said solid state electrical circuit means comprising anode cathode and gate terminal means, said cathode terminal means being electrically connected to one of said first and second movable contact means, said gate terminal means being electrically connected to an other of said first and second movable contact means, said resilient means comprising electrically conductive spring means, and said spring means electrically interconnecting said anode terminal means to one of said first and second stationary contact means.

25. A pressure responsive electrical switch assembly, comprising housing means, pressure responsive movable wall means carried by said housing means, said movable wall means effectively defining first and second chamber means within said housing means, at least first and second stationary contact means operatively carried by said housing means, at least first and second movable contact means operatively carried by said movable wall means, solid state electrical circuit means operatively carried by said movable wall means and electrically connected to said first and second movable contact means, resilient means normally operatively biasing said movable wall means in a direction toward said first chamber means and operatively biasing said first and second movable contact means in a direction away from said first and second stationary contact means, first electrical terminal means forming an electrical extension of said first stationary contact means, and second electrical terminal means forming an electrical extension of said second stationary contact means, said first and second movable contact means being generally coplanar, and said first and second stationary contact means being located as to be effectively at different operational elevations with respect to each other and with respect to said first and second movable contact means.

26. A pressure responsive electrical switch assembly, comprising housing means, fluid pressure responsive movable wall means carried by said housing means, said movable wall means effectively defining first and second chamber means within said housing means, at least first and second stationary contact means operatively carried by said housing means, at least first and second movable contact means operatively carried by said movable wall means, solid state electrical circuit means operatively carried by said movable wall means and electrically connected to said first and second movable contact means, and resilient means normally operatively biasing said movable wall means in a direction toward said first chamber means and operatively biasing said first and second movable contact means in a direction away from said first and second stationary contact means, said first and second movable contact means being generally coplanar, and said first and second stationary contact means being located as to be effectively at different operational elevations with respect to each other and with respect to said first and second movable contact means.

* * * * *